United States Patent [19]

Kusumoto et al.

[11] 4,211,066

[45] Jul. 8, 1980

[54] STOP WATCH

[75] Inventors: Yasuo Kusumoto; Joichi Miyazaki, both of Tokyo, Japan

[73] Assignee: Kabushiki Kaisha Daini Seikosha, Tokyo, Japan

[21] Appl. No.: 947,199

[22] Filed: Sep. 29, 1978

[51] Int. Cl.[2] ..... G04F 7/00; G04F 10/04

[52] U.S. Cl. ..... 368/113; 368/101; 368/106; 368/110

[58] Field of Search ..... 58/23 R, 21.13, 39.5, 58/74, 152 R, 153; 235/92 T, 92 PE; 324/186

[56] References Cited

U.S. PATENT DOCUMENTS

| | | | |
|---|---|---|---|
| 3,795,099 | 3/1974 | Tsuruishi | 58/153 |
| 3,884,035 | 5/1975 | Jeannet et al. | 58/39.5 |

*Primary Examiner*—Edith S. Jackmon

*Attorney, Agent, or Firm*—Robert E. Burns; Emmanuel J. Lobato; Bruce L. Adams

[57] ABSTRACT

A stop watch comprising a second hand and a subsecond hand includes manually actuatable switches for producing start, stop and reset instruction signals. A first stepping motor and a first drive controller for the stepping motor drives the second hand, while a second stepping motor and a second drive controller drives the subsecond hand. The second drive controller includes a counter for counting subsecond clock pulses in response to the start signal for effecting the display of the contents of the counter by the subsecond hand in response to the stop signal.

11 Claims, 13 Drawing Figures

COINCIDENCE DETECTING CIRCUIT
SECOND DISPLAY
COUNTER
COUNTER
DRIVE CIRCUIT

STOP WATCH

BACKGROUND OF THE INVENTION

The present invention relates to a stop watch which electrically measures the time and displays a measured time by hands.

In the conventional so-called mechanical type stop watch, it is impossible to sufficiently increase the accuracy of the escapement which is the generating source of the reference signal for time measuring, and also to obtain an accuracy of about 1/100 second as a result of various limitations. Also, since the display system uses hands for displaying the time and the driving system is operated by a single system, only functions of start, stop, reset or lap time measuring repeating start and stop are attained. As a result of this, there are disadvantages that, for example, in the case of the short-time measuring in which a high accuracy of measuring is required, the necessary functions are not obtained, and, in addition, at least two stop watches must be used for the lap time measuring of a swimming race or the like.

SUMMARY OF THE INVENTION

An object of the present invention is to provide a stop watch in which measuring a time and displaying the resulting time are accomplished by using one time measuring and display mechanism for the timing of more than a second and another time measuring and display mechanism for the timing of less than a second, and a circuit for storing the measured time is incorporated if necessary, whereby the time measuring can be carried out with high accuracy, and it is possible to stop the display operation during the continuation of the time measuring operation, if necessary.

Hereinafter, the detailed explanation will be made in conjunction with the drawings wherein:

DETAILED DESCRIPTION OF THE INVENTION

Figure 1:
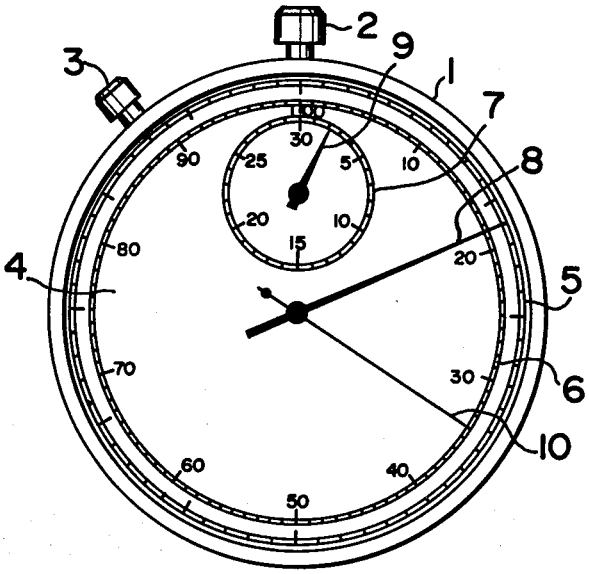
FIG. 1 is an outline view which shows one embodiment of a stop watch according to the present invention.

In FIG. 1 showing an external view of one embodiment of a stop watch according to the present invention, reference numeral 1 indicates a case. A switch button 2 for instructing the lap time midway notice operation after the stop of time measuring is arranged in the case 1 in such a way that it can be manually operated. On the other hand, a dial plate 4 has a second scale 5 for the measuring time in units of one second, a 1/100 second scale 6 for the measuring time in units of 1/100 second, and a minute scale 7 for the measuring time in the units of one minute. On the upper portion of the dial plate 4, a second hand 8 and a minute hand 9 are arranged which belong to a first display mechanism, and a sub-second hand 10 is arranged which belongs to a second display mechanism and displays the time in units of 1/100 second.

Figure 2:
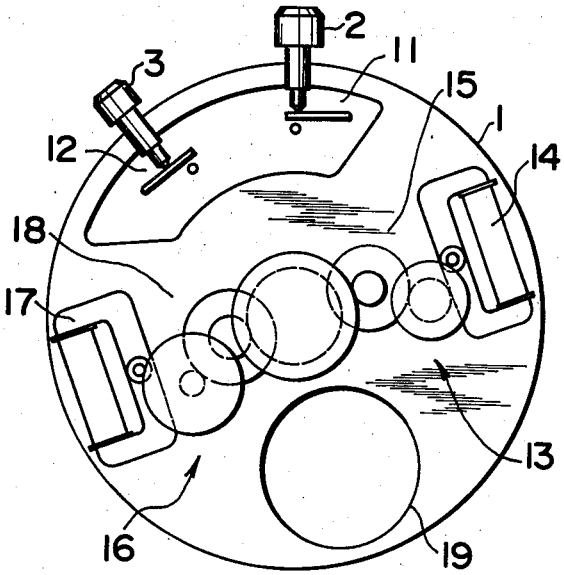
FIG. 2 is a diagrammatic illustration showing an inner portion of the embodiment shown in FIG. 1.

FIG. 2 is a diagrammatic illustration showing an inner portion of the stop watch shown in FIG. 1. In FIG. 2, reference numeral 11 is an on-off switch actuated by operating the switch button 2, and reference numeral 12 is an on-off switch actuated by operating the switch button 3. These switches 11 and 12 belong to a switch circuit 23 which will be described later. On the other hand, in the case 1 of the stop watch, a first stepping motor 14, the first display mechanism 13 involving a gear train 15 which is driven by the motor 14 and which moves the second hand 8, a second stepping motor 17, and the second display mechanism 16 involving a gear train 18 which is driven by the motor 17 and which moves the sub-second hand 10 are arranged. The minute hand 9 is moved by another gear train (not shown) engaged with the gear train 15. Furthermore, reference numeral 19 indicates a battery as a self-contained power supply.

Figure 3:
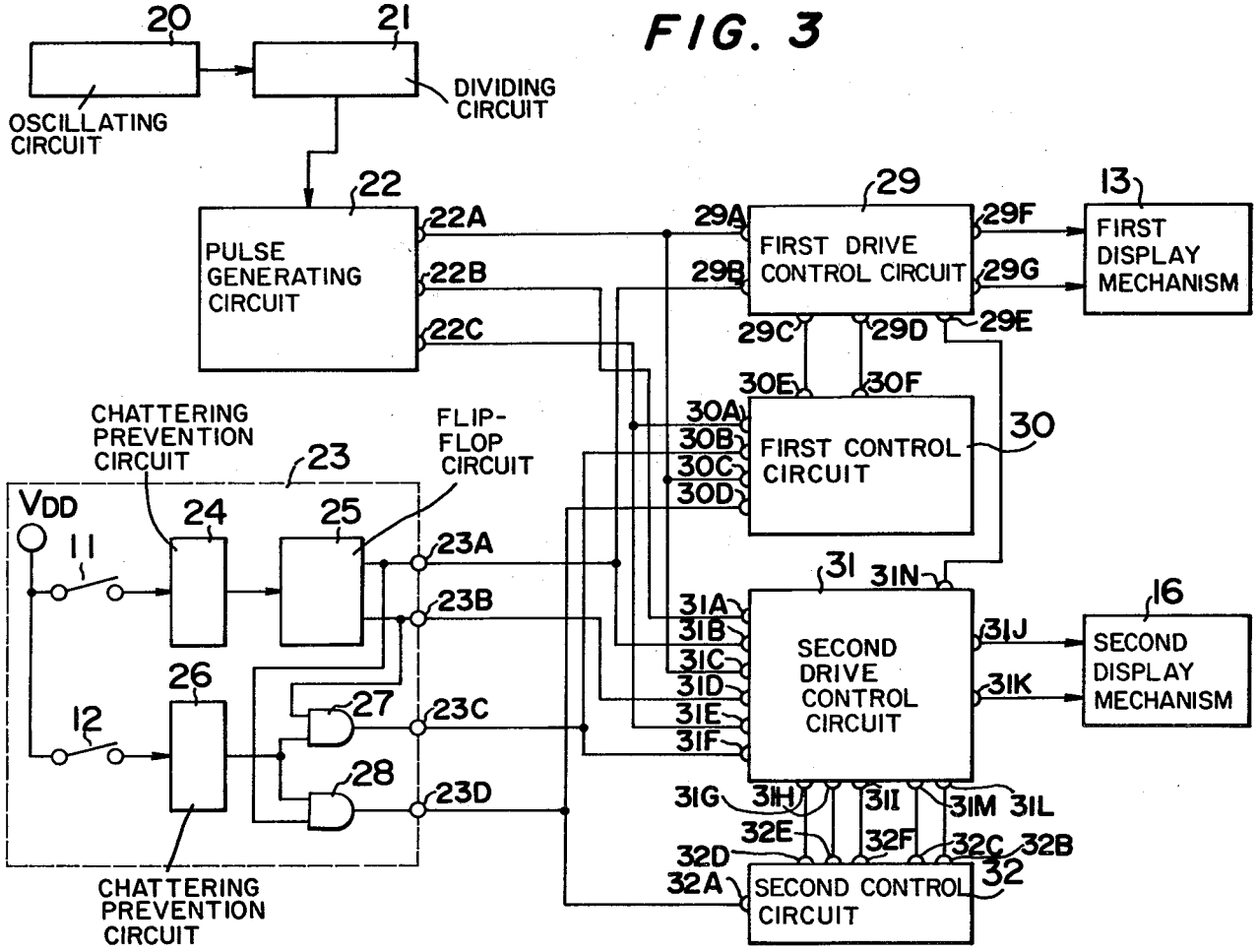
FIG. 3 is a block diagram shown the system of a stop watch according to the present invention.

FIG. 3 is a block diagram of the circuit portion of the stop watch according to the present invention, and reference numeral 20 indicates an oscillating circuit using a quartz vibrator. The original signal produced by the oscillating circuit 20 is supplied to a frequency dividing circuit 21, and the signal is divided down to a frequency divided signal having a predetermined frequency. Reference numeral 22 indicates a pulse generating circuit to which the frequency divided signal is applied, and the circuit 22 produces a first clock pulse having a frequency of 1 Hz, a second clock pulse having a frequency of 100 Hz and a third clock pulse having a frequency of 128 Hz from three output terminals 22A, 22B and 22C, respectively. These three clock pulses have the same pulse width, and are synchronized with one another, as shown by waveforms **22*a*, 22*b*, and 22*c* in FIG. 4**. The third clock pulse is the signal which is never present when the first clock pulse is present. The detailed circuit construction to obtain the first clock pulse through the third clock pulse can be easily realized by using conventional circuit techniques so that a detailed circuit diagram is omitted.

Figure 5:
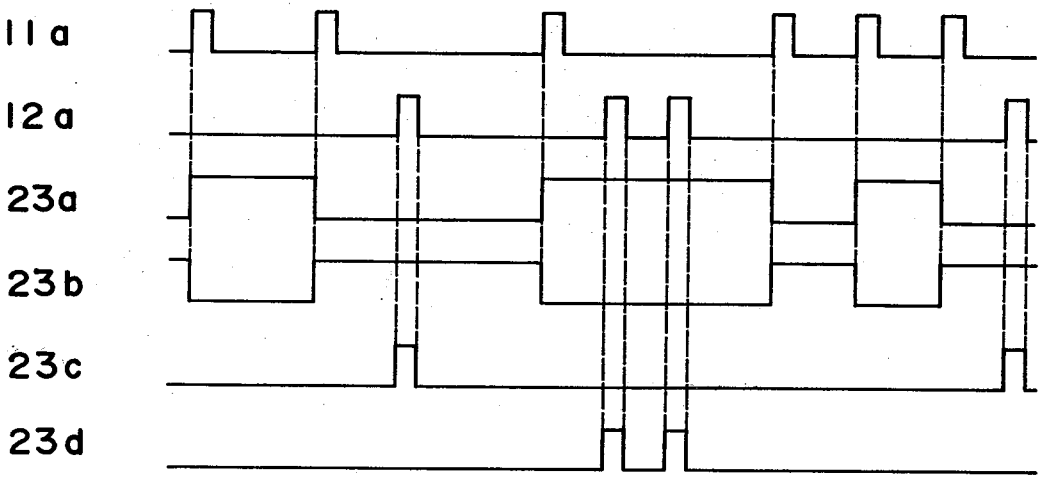
FIG. 5 is a timing diagram for explaining the operation of the switch circuit shown in FIG. 3.

Reference numeral 23 is the switch circuit involving the switches 11 and 12 shown in FIG. 2, and the switch circuit 23 has a bounce or chattering-prevention circuit 24 connected to the switch 11, a flip-flop circuit (which is referred to as FF, hereinafter) 25 which is driven by the rising edge of the output signal thereof used as the clock signal, a chattering-prevention circuit 26 connected to the switch 12, a two-input AND circuit 27 having the output from the circuit 26 and the Q output of the FF25 connected to its inputs and a two-input AND circuit 28 having the output from the circuit 26 and the $\overline{Q}$ output of the FF25 connected to its input. Therefore, when switches 11 and 12 are operated as shown by waveforms **11*a* and 12*a* in FIG. 5, instruction signals shown by waveforms 23*a*, 23*b*, 23*c* and 23*d* are produced from output terminals 23A, 23B, 23C and 23D**, respectively.

Reference numeral 29 shows a first drive control circuit, to the input terminal 29A of which the first clock pulse 22*a* is applied and to the input terminal 29B of which the starting-instruction signal 23*a* for time measuring is applied. As described in detail hereinafter, the drive controlling circuit 29 is controlled by control signals applied to input terminals 29B, 29C, 29D and 29E, respectively, and produces first driving pulses for driving the first stepping motor 14 (shown in FIG. 2) from output terminals 29F and 29G. These first driving pulses are applied to the first display mechanism 13.

Reference numeral 30 is a first control circuit which produces a control signal for controlling the above-mentioned first drive control circuit 29 via output terminals 30E and 30F when the midway notice instruction signal is applied to the input terminal 30D during the time measuring operation and it is cancelled. The first control circuit 30 has input terminals 30A through 30C other than the above-mentioned terminals, to which each of them the third clock pulse for quick feeding, the reset instruction signal and the first clock signal are applied.

Reference numeral 31 is a second drive control circuit wherein the second clock pulse is applied to the input terminal 31A thereof, and a second driving pulse for driving the second stepping motor (shown in FIG. 2) is produced from the output terminals 31J and 31K thereof on the basis of the second clock pulse and in response to the signal applied to input terminals 31A through 31I thereof.

Reference numeral 32 is a second control circuit which produces a control signal for controlling the second drive control circuit 31 via output terminals 32D through 32F when the midway notice instruction signal is applied to the input terminal 32A during the time measuring operation, and it is cancelled.

Next, the first and the second drive control circuits 29 and 31, and the first and the second control circuits shown in FIG. 3 will be explained in detail in conjunction with FIG. 6, FIG. 7, and so on.

Figure 6:
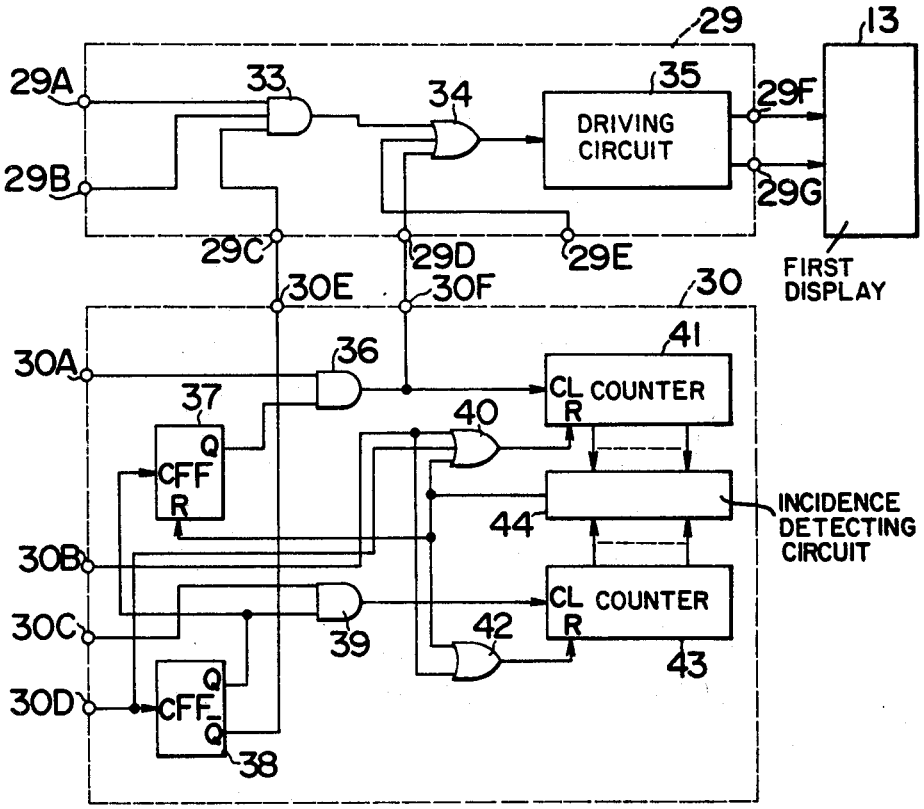
FIG. 6 is a circuit diagram of one embodiment of the first drive control circuit and the first control circuit.

FIG. 6 shows the first drive controlling circuit 29 and the first control circuit 30 shown in FIG. 3. The first drive controlling circuit 29 consists of a three-input AND circuit 33 to the inputs of which the first clock pulse, the Q output produced from the FF25 in the switch circuit which is the start instruction signal for the time measuring operation, and the control signal which is the input from the first control circuit 30 via the input terminal 29C are applied, a three-input OR circuit 34 to the inputs of which the output of the AND circuit 33, the control signal from the input terminal 29D and the signal from the input terminal 29E are applied, and a driving circuit 35 generating the first driving pulse having two phases and driving the first stepping motor 14 on the basis of the output signal from the OR circuit 34.

On the other hand, the first control circuit 30 consists of a two-input AND circuit 36 to one input of which the third clock pulse is applied, a FF37 of the falling edge triggering type supplying the $\overline{Q}$ output thereof to the other input of the AND circuit 36, a FF38 of the rising edge triggering type having a clock terminal C to which the midway notice instruction signal is applied via an input terminal 30D and the Q output supplied to the clock terminal C of the FF37, a two-input AND circuit 39 to the inputs of which the Q output of the FF38 and the first clock pulse from the input terminal 30C are applied, three-input OR circuit 40 to which the reset instruction signal from the input terminal 30B, the midway notice instruction signal from the input terminal 30D, and the coincidence signal from an incidence detecting circuit 44 described hereinafter are applied, a sixty count counter 41 having a clock terminal CL the which the output from the AND circuit 36 is applied and a reset terminal R to which the output from the OR circuit 40 is applied, a two-input OR circuit 42 to which the midway notice instruction signal and the coincidence signal are applied, a sixty count counter 43 having a clock terminal CL to which the output of the AND circuit 39 is applied and a reset terminal R to which the output of the OR circuit 42 is applied, and the coincidence detecting circuit 44 to which each of the output bits of the counters 41 and 43 are simultaneously applied. In addition, the coincidence detecting circuit 44 is arranged to produce a pulse-like coincidence signal as soon as the counting contents of the counter 41 is coincident with the counting contents of the counter 43.

The operation of the first drive controlling circuit 29 and the first control circuit 30 constructed as mentioned above will be explained with regard to each of the cases of a start-stop-reset operation, a start-stop-start-stop-reset operation, and a start-midway notice-midway notice releasing-stop-reset operation.

Figure 7:
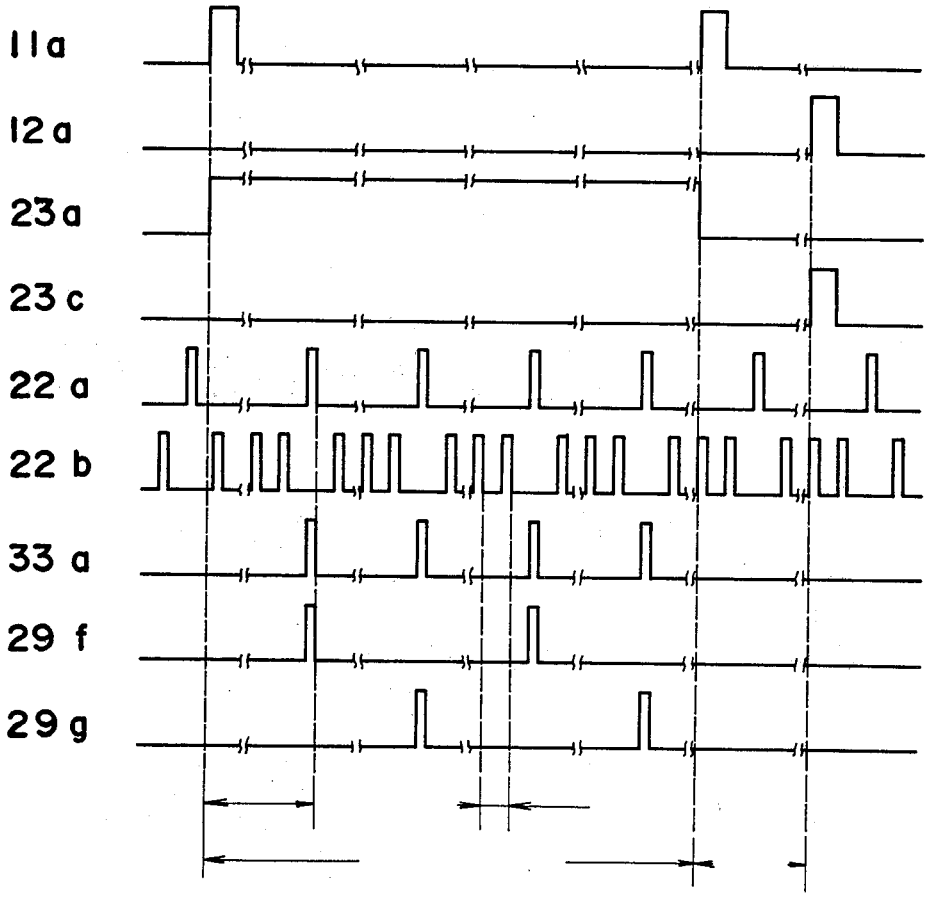
FIGS. 7 through 9 are timing diagrams for explaining the operation of the circuit shown in FIG. 6.

First of all, in the first case, the switches 11 and 12 are operated in accordance with the waveforms 11*a* and 12*a* in FIG. 7. By this operation, the start instruction signal for the time measuring operation and the reset instruction signal, the waveforms of which are shown by references 23*a* and 23*c*, are produced from output terminals 23A and 23C of the switch circuit 23. Since the stop instruction signal for the time measuring operation is the reverse signal of the start instruction signal, it will be easily understood that the signal shown by the waveform 23*a* is substantially used for same.

On the other hand, the first pulse of 1 Hz and the third pulse of 128 Hz are produced from the output terminals 22A and 22B of the pulse generating circuit 22 as shown by the wave forms 22*a* and 22*b*. In the meanwhile, in the first control circuit 30, FFs 37 and 38 can not be operated though each of the above-mentioned signals is supplied. Therefore, the $\overline{Q}$ output of the FF38 is "1" and the output of the AND circuit 36 stays at "0". As a result of which, when the signal shown by the waveform 23*a* becomes "0", the waveform of the output of the AND circuit 33 becomes the waveform as shown by the waveform 33*a*, the first driving pulse shown by the waveforms 29*g* and 29*f* is produced from the driving circuit 35, and it is applied to the first display mechanism 13. After this, when the logical level of a start instruction signal for the counting operation (it is substantially equal to the stop instruction signal) becomes "0", the output of the AND circuit 33 becomes "0", and the production of the first drive pulse is stopped. After this, the second hand (shown in FIG. 1) is mechanically returned to the "0" mark at the time of producing the reset instruction signal.

Figure 8:
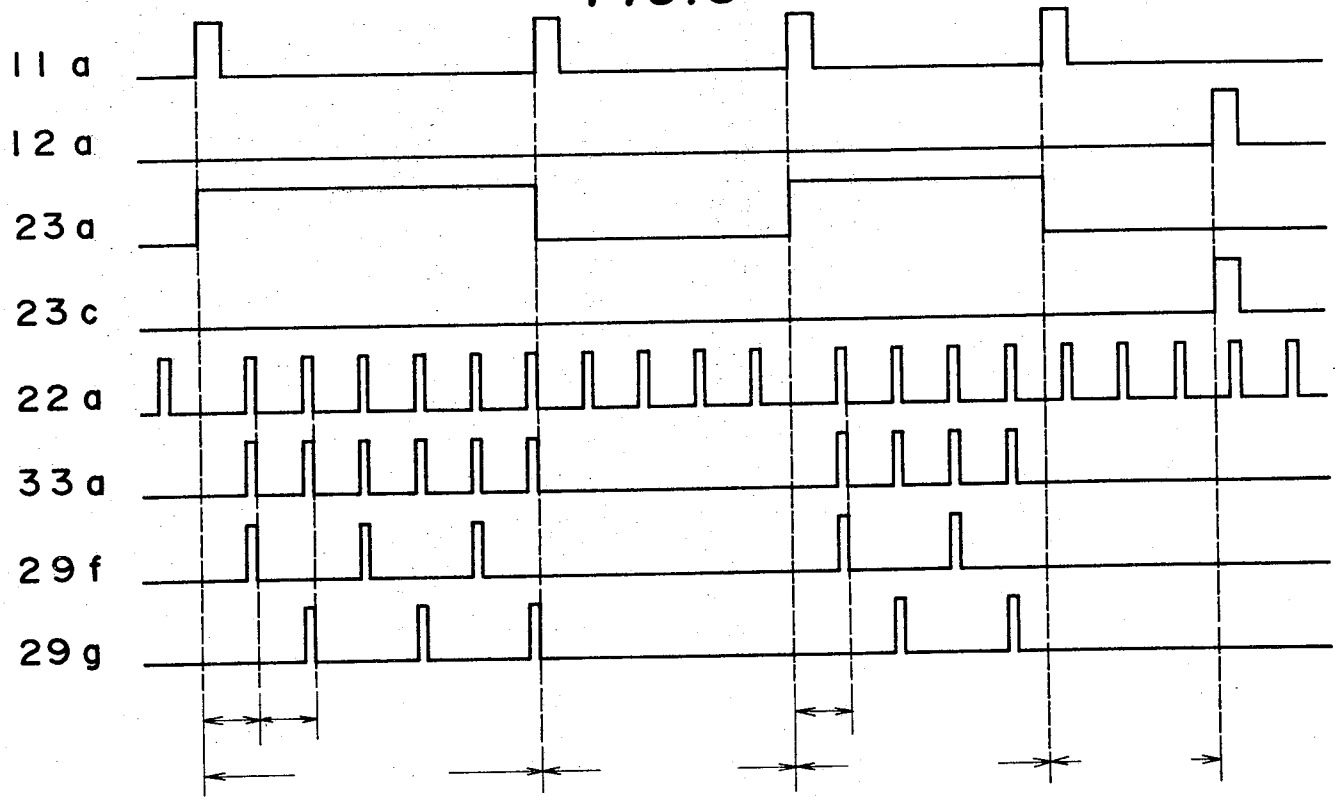

In the second case, the switches 11 and 12 are operated in accordance with the waveforms 11*a* and 12*a* in FIG. 8, and the signals shown by the waveforms 23*a* and 23*c* are produced from the output terminals 23A and 23C of the switch circuit 23. Therefore, in a like manner to the first case, the FFs 37 and 38 in the first control circuit 30 can not be operated. As a result, the signal shown by the waveform 33*a* is produced from the AND circuit 33, and at the output terminals 29F and 29G the first driving pulses shown by waveforms 29*f* and 29g can be obtained. With regard to the reset operation, it is the same as the operation in the first case.

Figure 4:
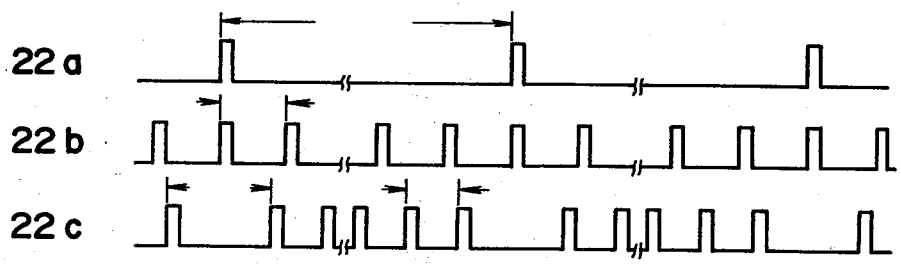
FIG. 4 is a timing diagram of the signals produced from the pulse generating circuit shown in FIG. 3.
Figure 9:
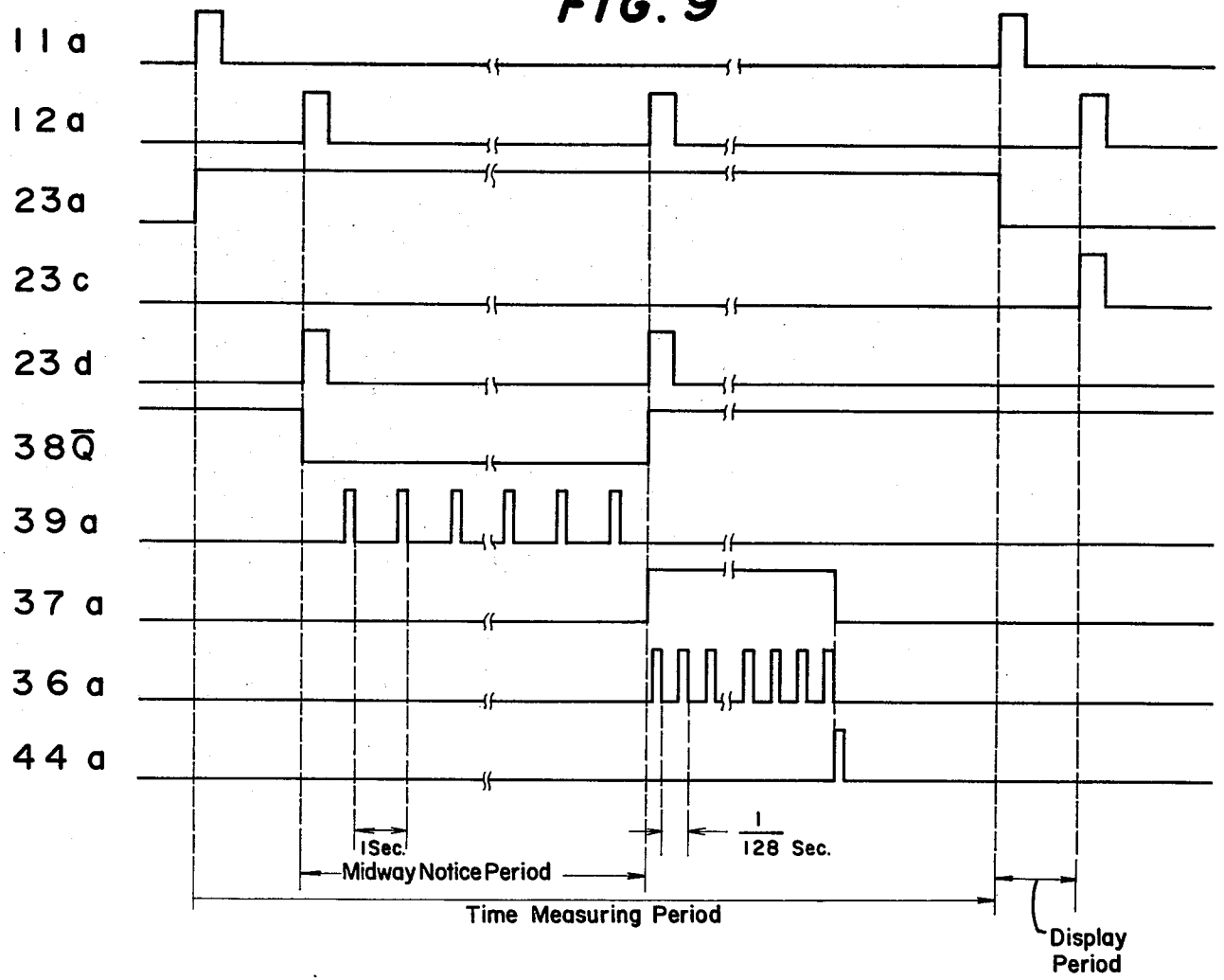

Next, in the third case, that is, in the case that during the time measuring operation confirming the midway-lapse time is required, after once operating the switch 11, operating the switch 12 is required. An example of the operating condition is shown by the wave forms 11a and 12a in FIG. 9. With this operation, the signals shown by the waveforms 23a, 23c and 23d are produced from output terminals 23A, 23C and 23D of the switch circuit 23. It carries out the same operation as the operation in the first case or the second case until the signal shown by the wave form 23a becomes "1" and the midway notice instruction signal (waveform 23d) is produced. Then, as shown by the waveform 38$\overline{Q}$ the $\overline{Q}$ output of the FF38 is changed into "0" by producing the midway notice instruction signal. Thus, the production of the first pulse from the AND circuit 33 is stopped and the second hand 8 (shown in FIG. 1) stops. In this condition, the midway-lapse time can be seen by reading the indication value of the second hand 8. On the other hand, the clock pulse of 1 Hz shown by the waveform 39a is produced from the AND circuit 39 by changing the Q output level of the FF38 into the "1" level, and the counter 43 counts it. This counter 43 is the counter for measuring the stopping time of the second hand 8. Once the switch 12 is operated at the time when the counting contents in the counter 43 becomes "0", the Q output of the FF38 will be returned to the "0" level. On the other hand, as shown by a waveform 37, the Q output of the FF37 becomes "1" in response to the change of the Q output of the FF38. As a result of which, the third clock pulse for quick feeding having a frequency of 128Hz (waveform 36a) is produced from the AND circuit 36. This clock pulse is supplied to the OR circuit 34, and changed into the first driving pulse for driving the first stepping motor 14, which clock pulse is counted by the counter 41. When the counting contents in the counter 41 becomes "10", it is coincident with that in the counter 43. The coincidence detecting circuit 44 produces the coincident signal (waveform 44a) in response to the incidence condition, counters 41 and 43 are reset and the FF37 is also reset. The lag due to the midway notice time can be recovered by this operation. Though the normal clock pulse of 1Hz is sometimes supplied via the AND circuit 33 during the quick feed operation of the above-mentioned second hand 8, at the time of the generation of the pulse the clock pulse of 128Hz is not produced as shown in FIG. 4. Therefore, no trouble substantially occurs by the time lag due to quick feeding. After this, the stop operation or the reset operation for measuring can be made by operating the switch 11 and the switch 12. The operation is the same operation as that in the first case or the second case.

Figure 10:
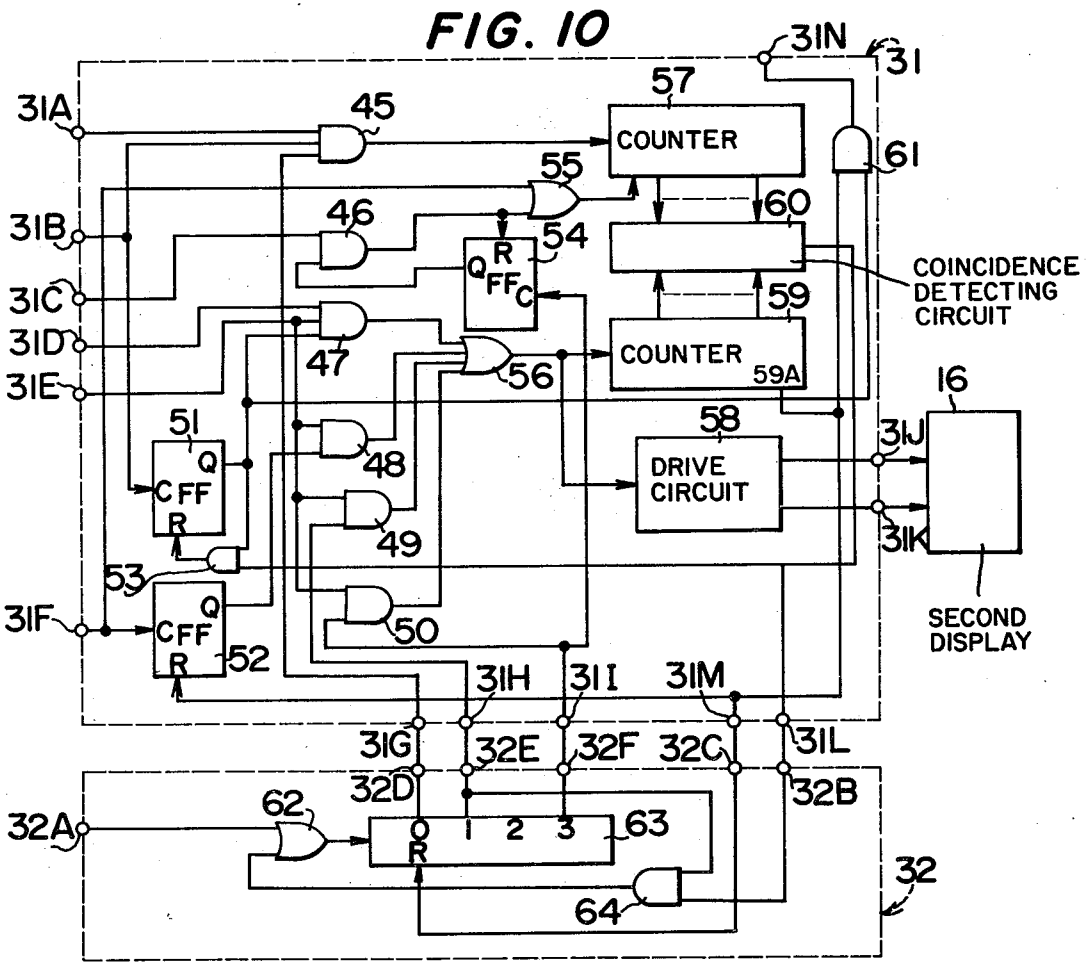
FIG. 10 is a circuit diagram of one embodiment of the second drive control circuit and the second control; and, FIGS. 11 through 13 are timing diagrams for explaining the operation of the circuit shown in FIG. 10.

FIG. 10 shows the second drive controlling circuit 31 and the second control circuit 32 shown in FIG. 3. The second drive control circuit 31 comprises a three-input AND circuit 45 to which the second clock pulse of 100Hz, the Q output of FF25 in the switch circuit 23 being the start instruction signal for the time measuring operation, and the control signal from the input terminal 31G are applied, a two-input AND circuit 46 to which the first clock pulse from the input terminal 31C and the Q output of a FF54 (which will be described hereinafter) are applied, a three-input AND circuit 47 to which the stop instruction signal for the time measuring operation, the third clock pulse of 128Hz and the Q output of the FF51 (which will be described hereinafter) are applied, a two-input AND circuit 48 to which the third clock pulse and the Q output of the FF52 (which will be described hereinafter) are applied, a two-input AND circuit 49 to which the third clock pulse and the control signal from the input terminal 31H are applied, and a two-input AND circuit 50 to the which the third clock pulse and the control signal from the input terminal 31I. In addition, the second drive controlling circuit 31 further comprises the FF51 driven by the falling edge of a pulse to the clock terminal C of which the start instruction signal for the time measuring operation is applied, the FF52 driven by the rising edge to the clock terminal C of which the reset instruction signal is applied, a two-input AND circuit 53 to one input terminal of which the Q output of the FF51 is applied and the output of which is applied to the reset terminal R of the FF51, the FF54 driven by the falling edge of a pulse to the clock terminal C of which the control signal from the input terminal 31I is applied, a two-input OR circuit 55 to which the output of the AND circuit 46 and the reset instruction signal are applied, a four-input OR circuit 56 to which each of outputs of the AND circuits 47 through 50 is applied, a hundred count counter 57 to which the output of the AND circuit 45 is applied to the clock terminal C thereof and the output of the OR circuit 55 is applied to the reset terminal R thereof, a driving circuit 58 to which the output of the OR circuit 56 is applied and the second driving pulse having two-phases for driving the second stepping motor 17 (shown on FIG. 2) is generated in the basis of the output from the OR circuit 56, a hundred count counter 59 to which the output of the OR circuit 56 is applied to the clock terminal C thereof and the pulse is produced from the output terminal 59A thereof at the time of the condition when the counting contents thereof becomes "0", a coincidence detecting circuit 60 to which each of the output bits of counters 57 and 59 is supplied, and a two-input AND circuit 61 to which the output from the output terminal 59 of the counter 59 and the Q output of the FF51 are applied. In addition, the coincidence signal is applied to the remaining input terminal of the AND circuit 53 and the output terminal 31L. The signal from the output terminal 59A of the counter 59 is applied to the reset terminal R of the FF52 and the input terminal 32C of the second control circuit 32 via the output terminal 31M.

On the other hand, the second control circuit 32 consists of a two-input OR circuit 62 to one input terminal of which the midway notice instruction signal is applied, a four-bit ring counter 63 to the clock terminal C of which the output from the OR circuit 62 is applied, and a two-input NAND circuit 64 to which the $Q_1$ bit output of the ring counter 63 and the signal from the input terminal 32B are supplied, and the output from the NAND circuit 64 is applied to the remaining input terminal of the OR circuit 62. In addition, the signal from the input terminal 32B is applied to the reset terminal of the ring counter 63, and the logical condition of a $Q_0$ bit of the ring counter 63 is changed into the "1" by the reset signal.

The operation of the second drive controlling circuit 31 and the second control circuit 32 constructed as mentioned above will be explained for each of three cases in the same way as in the case of the first drive controlling circuit and the first control circuit.

Figure 11:
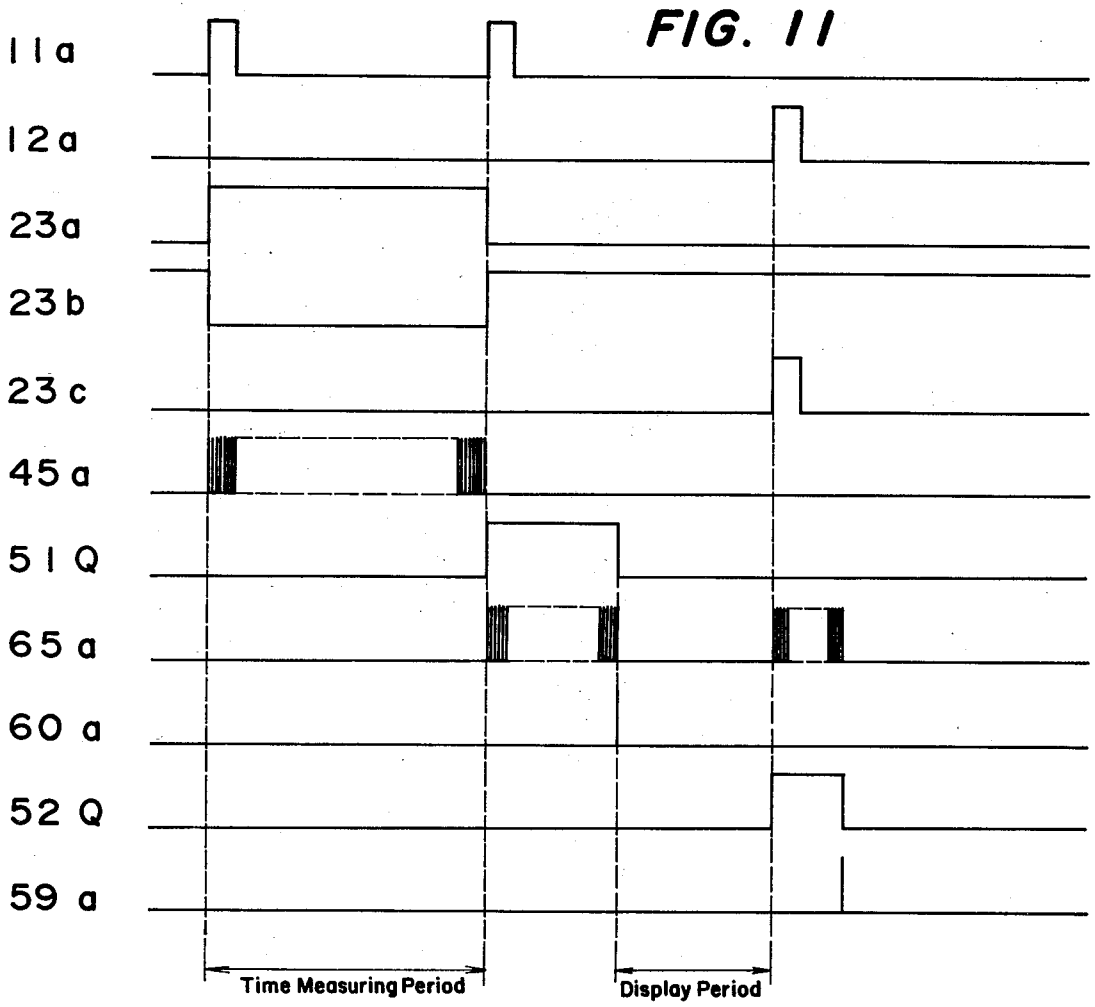

First of all, in the first case, the switches 11 and 12 are operated in accordance with the wave forms 11a and 12*a* in FIG. 11. By this operation, each instruction signal is produced from the output terminals 23A, 23B and 23C of the switch circuit 23, respectively, and these signals show the waveforms 23*a*, 23*b* and 23*c*. On the other hand, since the midway notice instruction signal is not supplied, to the second control circuit 32, the logical level of the $Q_0$ bit in the ring counter 63 stays at "1". In this condition, at first, when the start instruction signal for the time measuring operation (waveform 23*a*) is produced, the clock pulse of 100 Hz shown by the waveform 45*a* is supplied from the AND circuit 45. This clock pulse is counted by the counter 57. The counting contents are changed from "1" to "100" in the maximum case during one second, and this condition is repeated. Then, it is assumed that when the counting contents is, for example, "34", the switch 11 is operated. For this operation, the logical condition of the input terminals 31B becomes "0", at the same time the logical condition of the input terminal 31D becomes "1", and the Q output (waveform 51Q) of the FF51 driven by the falling edge of a pulse becomes "1". As a result, as shown by the waveform 56*a*, the third clock pulse for the quick feeding operation is produced from the OR circuit 56. This pulse is applied to the driving circuit 58 and the counter 59. Therefore, due to this operation, the second stepping motor 17 will be driven and the sub-second hand 10 will be moved. On the other hand, the coincidence detecting circuit 60 produces the coincident signal (waveform 60*a*) in response to the condition in which the counting contents of the counter 57 being to be "34" is coincidence with the counting contents of the counter 59. The FF51 is reset by producing the coincident signal and the production of the clock pulse from the OR circuit 56 is stopped. Namely, on the basis of the stop instruction for the counting operation, the sub-second hand 10 is fed quickly, the display corresponding to the counting contents of the counter 57 is made, and then the resulting display can be read out in units of 1/100 within one second after operating the switch button 2. Next, when the reset instruction signal (waveform 23*c* ) is generated, the Q output of the FF52 (waveform 52Q) becomes "1". As a result, the third clock pulse of 128 Hz is supplied to the counter 59 via the AND circuit 48 and the OR circuit 56. The counter 59 counts the pulse, generates the pulse (waveform 59*a*) from the output terminal 59A thereof at the time when the counting contents becomes all "0", and the FF52 is reset by the pulse. The counter 57 is also reset on the basis of the above-mentioned reset instruction. On the other hand, the pulse delivered via the OR circuit 56 is also supplied to the drive circuit 57. Consequently, the sub-second hand 10 is also returned to the zero point of the scale on the basis of the reset instruction.

Figure 12:
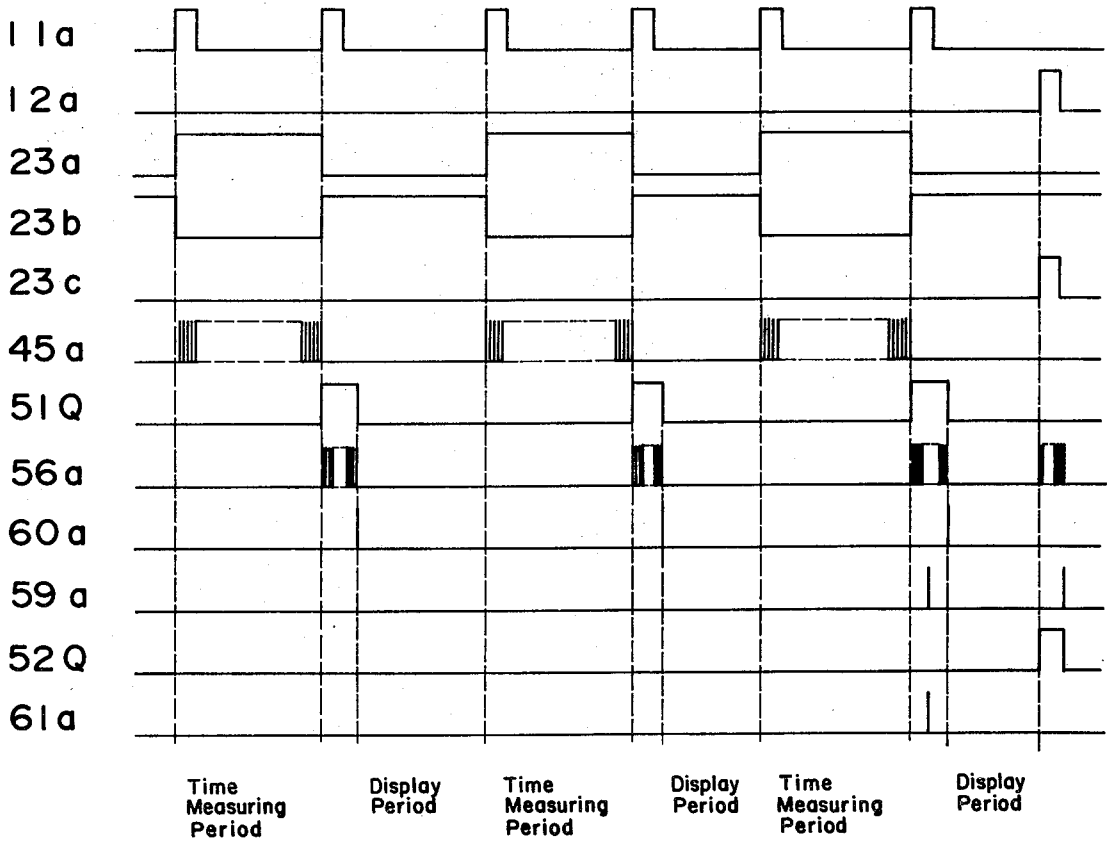

Next, in the second case, switches 11 and 12 are operated in accordance with the waveforms 11*a* and 12*a* in FIG. 12, and the signals shown by waveforms 23*a*, 23*b* and 23*c* are produced from the output terminals 23A, 23B and 23C in the switch circuit 23, respectively. Therefore, the operation in the time before the first of the coincidence signals (waveform 60*a*) is produced from the coincidence detecting circuit 60 is the same as the operation in the first case. In this case, if the counting contents of the counter 57 is, for example, "34", the counting contents of the counter 59 will be the same as 57 and each Q output of the FFs 51 and 52 will become "0". When the start instruction signal for the time measuring operation is applied under the above-mentioned conditions, the counter 57 continue the counting operation. However, for example, if the next stop instruction signal for the time measuring operation is generated after one second and fifty hundredth seconds, the counting contents of the counter 57 becomes all "0" after zero seconds, and one second of the start of the time measuring, and becomes "84" at the time generating the stop instruction signal. On the other hand, the clock pulse of 128 Hz is delivered via the AND circuit 47 and the OR circuit 56 on the basis of the signal, and when the counting contents of the counter 59 becomes "84" the coincidence detecting circuit 60 produces the concidence signal (waveform 60*a*). That is, it follows that fifty pulses have been supplied to the counter 59 and the drive circuit 58, as a result of which, "84" is displayed by the sub-second hand 10. After this, when the reset instruction signal is supplied, the Q output of the FF52 shown by the waveform 52Q becomes "1", and the operation after this is the same as the operation in the first case. On the other hand, it is assumed that the counting contents of the counters 57 and 59 are "84", respectively, after this it begins to count, and then the stop instruction signal for the time measuring operation is generated after one second and sixty hundredth seconds. In this case, the counting contents of the counter 57 becomes "44". On the other hand, the clock pulse of 128 Hz is supplied to the counter 59 in the basis of this signal, and when the counting contents of the counter 59 becomes all "0", that is, sixteen pulses have been supplied thereto, the counter 59 produces a pulse from the output terminal 59A. At this time, the Q output of the FF51 is set to "1". Therefore, the pulse shown by the waveform 61*a* is produced from the AND circuit 61, and the pulse is supplied to the OR circuit 34 in the drive controlling circuit 29 shown in FIG. 6. It will be understood that this pulse is used for moving the second hand one second, and the pulse serves as the so-called carry pulse.

Figure 13:
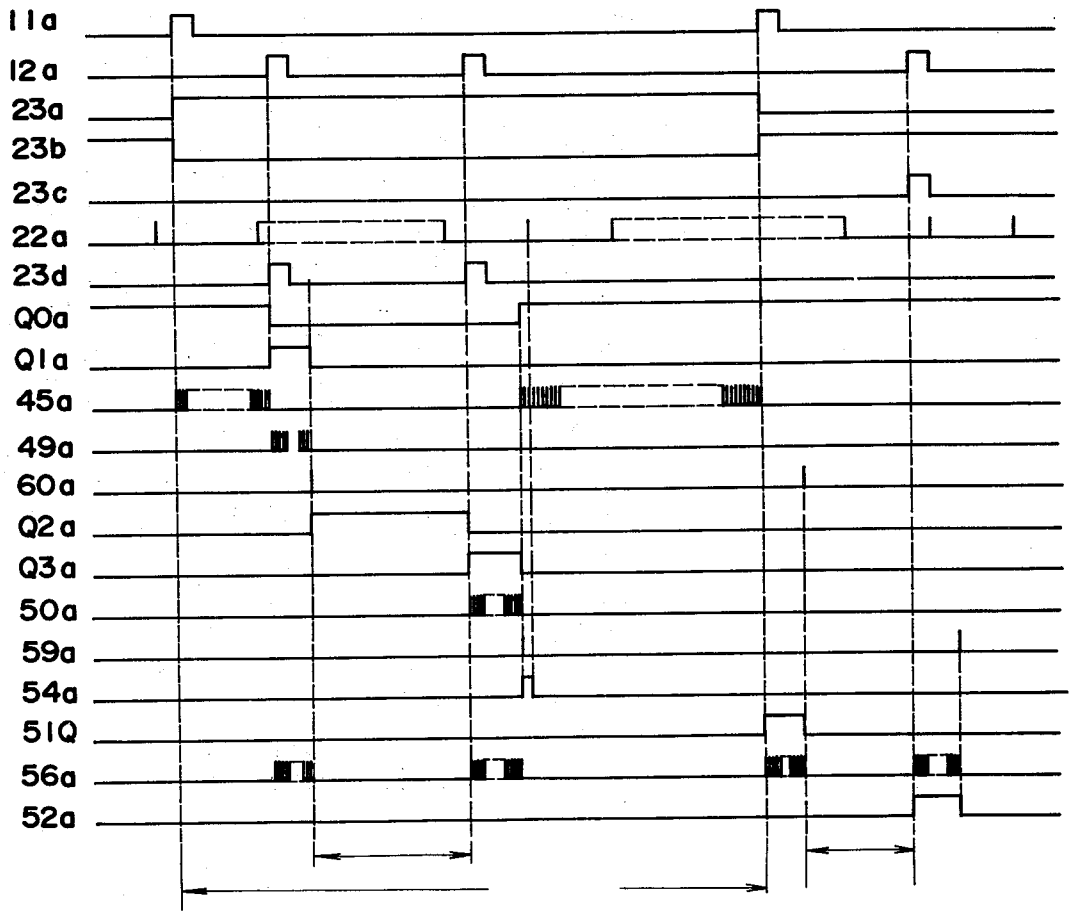

In the third case, that is, in the case that during the time measuring operation confirming the midway-lapse time is required, after once operation of the switch 11, operating the switch 12 is required. This operation mode is the same as that shown in FIG. 9, and the mode is shown by waveforms 11*a* and 12*a* in FIG. 13. With this operation, the signals shown by the waveforms 23*a*, 23*b*, 23*c* and 23*d* are produced from output terminals 23A through 23D. It carries out the same operation as the initial operation in the first case or the second case until the signal shown by the waveform 23*a* becomes "1" and the first pulse indicated by the waveform 23*d* (the midway notice instruction signal) is produced. In response to this pulse, the $Q_0$ output (wave form $Q_{0a}$) of the ring counter 63 in the second control circuit 32 is changed in logical level to "0", and the $Q_1$ output (wave form $Q_{1a}$) thereof is changed to "1". According to the above-mentioned changes, the output of the AND circuit 45 is in the condition which prevents the production of the second clock pulse of 100 Hz as shown by the waveform 45*a*, while the third clock pulse indicated by the waveform 49*a* is produced from the AND circuit 49. If it is assumed that the switch 12 is operated after 11.34 seconds from the start of the time measuring, the counting contents of the counter 57 will be "34". Therefore, when thirty-four pulses have been supplied to the counter 59 via the AND circuit 49 and the OR circuit 56, the coincidence detecting circuit 60 produces the coincidence signal indicated by the waveform 60*a*. The signal is applied to the ring counter 63 via the AND circuit 64 and the OR circuit 62 as a clock pulse. As a result of clock pulse, in the ring counter 63, only the $Q_2$ output indicated by the waveform $Q_{2a}$ goes to "1". In addition, while the $Q_1$ output is "1", the sub-second hand 10 is moved by thirty-four pulses supplied via the OR circuit 56, and displays "34". As described above, it is possible to easily read out the midway lapse time with high accuracy by the operation of the switch 11 and the operation of the switch 12 following the operation of the switch 11. After the midway lapse time is read out, this condition must be released. In this case, the switch 12 should be operated. The result makes the ring counter 63 carry out a shift operation, whereby the $Q_3$ output (wave form $Q_{3a}$) will become "1". In response to the change of the output, the third clock pulse indicated by the waveform 50*a* is produced from the AND circuit 50, and the pulse is applied to the counter 59 and the drive circuit 58. When supplied sixty-six pulses, the counter 59 generates the pulse signal (waveform 59*a*) from the output terminal 59A, the ring counter 63 is reset by the pulse, and the logical level of the $Q_0$ output is changed to "1". Since the sub-second hand 10 is moved by the sixty-six pulses, the sub-second hand 10 is returned to the zero mark of the scale before the $Q_0$ output is changed to "1". On the other hand, when the $Q_0$ output of the ring counter 63 is returned to "1", the counter 57 begins the counting operation. However, since the Q output of the FF54 (waveform 54Q) goes to "1", it is reset by the second pulse (a first clock pulse) produced at first after the reset operation thereof, the counter 57 can be returned to the initial counting condition wherein the numbers from 0 to 99 can be counted during one second. Therefore, after releasing the midway notice operation, it is impossible to operate the switch during some period, however, it is not disadvantageous in comparison with the recording time of the midway lapse time. When operating the switch 11, the counter 57 is stopped to count, and then the operation after this is the same as the operation in the first case or the second case.

As described above, since the stop watch according to the present invention comprises the second display mechanism 16 for measuring time less than a second, and the second drive control circuit 31 for driving it, it is possible to easily measure the time with the accuracy of 1/100 second. Also, when reading out the measuring contents, it is possible to completely eliminate the reading errors, because the display is made by the step driving of the stepping motor 17. In addition, since it comprises the first and the second control circuits 30 and 32, the display of the midway lapse time during the time measuring can be easily carried out by the switch operation. Also, it is extremely effective to prevent the sub-second hand 10 from being driven during the time measuring operation to prevent the waste of the power. On the other hand, the lapse time measuring, such as the operation repeating alternately the start and stop, is described for the case of three times repetition to simplify the explanation, however, it will be easily understood that the operation similar to the above-mentioned operation may be repeated any time, and repeating the midway notice is also possible. Though not shown in the figures, the frequency dividing circuit 21 is constructed in such a way that it is reset at the rising edge of the start instruction signal for the time measuring operation caused by operating the switch 11.

In the foregoing explanation, a stop watch according to the present invention has been explained in detail on the basis of an embodiment shown in the figures. However, the present invention is not limited to the embodiment shown in the figures, and various changes and modifications may be made to the invention without departing from the spirit and scope thereof. For example, though the pulse having a period of 1/100 second is used as the second clock pulse in the embodiment, a pulse having a period of 1/50 second, a pulse having a period of 1/200 second and so on can be used as the second clock pulse. However, in this case, the gear train 19 and the dial plate 4 must be changed. In addition, if a stepping motor having excellent frequency response is employed, the quick feed pulse having a higher frequency than the above-mentioned frequency can be used. Though the sixty count counters are used as the counters 41 and 43 in the embodiment, if the midway notice time of more than two minutes is required, a two hundred count counter or a three hundred count counter, for example, may be used as the counters 41 and 43. It is easily understood that switches or the switch circuit 23 can be changed according to various requests.

As described above, the mechanism of the stop watch according to the present invention is fundamentally different from that of the conventional mechanical type stop watch. Namely, since in the stop watch according to the present invention, the mechanism comprises the first display mechanism having the second hand indicating the time in a unit of one second and the first stepping motor, the first drive control circuit for driving it, the second display mechanism having the sub-second hand indicating the measured time in a measuring unit of less than a second and the second stepping motor, and the second drive control mechanism for driving it, it is easy to carry out the time measuring of, for example, 1/100 second, whereas it is difficult to measure such a time by the conventional mechanical type stop watch, and furthermore the stepping motor is used as a driving source so that reading errors can be prevented. In addition, since the stop watch has the first control circuit involving the circuit which produces the control signal for stopping the moving of the second hand to the first drive control circuit in response to a predetermined switch-operation during the time measuring operation and/or the second control circuit for sending a predetermined control signal to the second drive control circuit, it is easy to indicate the lapse time in the midway of the time measuring operation only by the operation of the switch, and furthermore, moving the sub-second hand is not carried out in the normal time measuring operation so that the waste of power can be prevented. Therefore, according to the present invention, the desired objects can be fully attained, and the effect is striking.

We claim:

1. A stop watch, comprising;

a first clock pulse having a period of 1 second;

a switch circuit for producing each of instruction signals of start, stop, reset and midway notice in response to the switch operation;

a first control circuit for generating a plurality of control signals in response to said midway notice instruction signal;

a first drive controlling circuit for generating first driving pulses based on said first clock pulse in response to said start and stop instruction signal, and said control signals;

a first stepping motor driven by said first driving pulses, and a first display mechanism having a second hand moved by said first stepping motor;

a second clock pulse having a period shorter than that of said first clock pulse;

a second control circuit for generating a plurality of control signals in response to the midway notice instruction from said switch circuit;

a second drive controlling circuit for generating second driving pulses based on said second clock pulse in response to the start, the stop and the reset signals generated in said switch circuit and the control signal from said second control circuit; and, a second stepping motor driven by said second driving pulse and a second display mechanism having a subsecond hand which is moved by said second stepping motor and displays the measured time less than the unit of second.

2. A stop watch as recited in claim 1 wherein said first control circuit has a counter for measuring the time during the second hand is stopped to move in response to the midway notice instruction signal, and the first control circuit is constructed so as to generate a control pulse recovering the loss time for displaying when the midway notice is released.

3. A stop watch as recited in claim 1 wherein said second control circuit comprises a ring counter for generating the plurality of control signals.

4. A stop watch as recited in claim 1 or claim 6 wherein said second drive controlling has a counter for measuring a time on the basis of said second clock pulse, and the second drive controlling circuit is constructed so as to generate said second driving pulse the number of which corresponds to the measuring contents of said counter in response to the stop instruction signal or one control signal from the second control circuit.

5. A stop watch as recited in claim 1 wherein the period of the second clock pulse is 1/100 second.

6. A stop watch comprising pulse generating means for producing a first clock pulse having a period of one second and a second clock pulse having a period of a fraction of one second; manually actuatable switch means for producing at least start, stop and reset instruction signals; frist drive controlling means for producing first driving pulses corresponding to said first clock pulses in response to the start and stop instruction signals; a first stepping motor driven by the first driving pulses; a second hand driven by the first stepping motor; a second stepping motor; a subsecond hand driven by the second stepping motor; and second drive controlling means for producing second drive pulses corresponding to said second clock pulses in response to the start and stop instruction signals for driving the second stepping motor, the second drive controlling means comprising a counter for counting said second clock pulses in response to the start signal and for effecting the display of the contents of the counter by the subsecond hand in response to the stop signal.

7. The stop watch according to claim 6, wherein the period of the second clock pulse is 1/100 second.

8. The stop watch according to claim 6, wherein the switch means produces a lap time instruction signal and the first drive controlling means includes a counter for counting said first clock pulses; and further comprising first and second control means for producing a plurality of control signals in response to the lap time signal for controlling the first and second drive controlling means, respectively, to effect the display of the counters of the first and second drive controlling means by the second hand and the subsecond hand in response to a lap time signal and the counting of the first and second clock pulses by the counters of the first and second drive controlling means during the display of the lap time by the second hand and the subsecond hand.

9. The stop watch according to claim 8, wherein the second control means comprises a ring counter for producing the control signals.

10. The stop watch according to claim 9, wherein the pulse generating means produces a third clock pulse having a smaller period than the second clock pulse and wherein the first and second drive controlling means each include another counter receptive of the third clock pulses and coincident detector for generating a coincidence signal when the two counters of each drive controlling means are the same.

11. The stop watch according to claim 10, wherein the period of the second clock pulse is 1/100 second and the period of the third clock pulse is 1/128 second.

* * * * *